US005635949A

United States Patent [19]

Shiratsuki et al.

[11] Patent Number: 5,635,949

[45] Date of Patent: Jun. 3, 1997

[54] DRIVING METHOD OF A LIQUID CRYSTAL DISPLAY HAVING FERROELECTRIC MATERIAL ACTIVE ELEMENTS

[75] Inventors: Yoshiyuki Shiratsuki; Yoshinori Yamaguchi; Kazuhiro Hayashi; Takehiro Niitsu, all of Kanagawa, Japan

[73] Assignee: Fuji Xerox Co., Ltd., Tokyo, Japan

[21] Appl. No.: 325,948

[22] Filed: Oct. 17, 1994

[30] Foreign Application Priority Data

Oct. 18, 1993 [JP] Japan ..... 5-259526

[51] Int. Cl.[6] ..... G09G 3/36

[52] U.S. Cl. ..... 345/94; 345/97; 345/90; 345/93

[58] Field of Search ..... 345/90–93, 210, 345/211, 214, 97, 94; 359/52, 56, 57, 58

[56] References Cited

U.S. PATENT DOCUMENTS

| | | | |
|---|---|---|---|
| 4,021,798 | 5/1977 | Kojima et al. | 345/90 |
| 4,378,557 | 3/1983 | Murata | 345/94 |
| 5,012,314 | 4/1991 | Tobita et al. | 345/92 |
| 5,349,366 | 9/1994 | Yamazaki et al. | 345/92 |

FOREIGN PATENT DOCUMENTS

| | | |
|---|---|---|
| 64-4721 | 1/1989 | Japan . |
| 5-249469 | 9/1993 | Japan . |
| 6-202144 | 7/1994 | Japan . |

OTHER PUBLICATIONS

"Active Matrix Liquid Crystal–Principle–" (in Japanese), Flat Panel Display 1990, pp. 110–123, Nikkei Business Publication, published Nov. 1, 1989.

"Color Liquid Crystal Display" (in Japanese), pp. 141–154, Sangyo Tosho Publishing Company, published Dec. 14, 1990.

*Primary Examiner*—Richard Hjerpe
*Assistant Examiner*—Vui T. Tran
*Attorney, Agent, or Firm*—Finnegan, Henderson, Farabow, Garrett & Dunner, L.L.P.

[57] ABSTRACT

Each pixel consists of an image electrode formed on a first insulating substrate, a ferroelectric material portion formed on the image electrode, a pixel electrode formed on the ferroelectric material layer, a scanning electrode formed on a second insulating substrate, and a liquid crystal portion disposed between the pixel electrode and the scanning electrode. When an input signal is written to the respective pixels, a liquid crystal portion of each of pixels selected for display is supplied with an effective voltage that makes a transmittance of the liquid crystal portion smaller than 50%.

10 Claims, 6 Drawing Sheets

DRIVING METHOD OF A LIQUID CRYSTAL DISPLAY HAVING FERROELECTRIC MATERIAL ACTIVE ELEMENTS

BACKGROUND OF THE INVENTION

The present invention relates to a driving method of an active matrix type liquid crystal display which uses, as pixel drive elements, active elements made of a ferroelectric material.

At present, matrix type liquid crystal displays are mainly used in which pixels are arranged in a matrix form. And the matrix type liquid crystal displays are classified into the simple matrix type and the active matrix type in terms of the driving method.

The active matrix type liquid crystal display has a configuration in which memory elements each consisting of a capacitor and a nonlinear resistor element such as a diode or a transistor are connected to respective pixels. The capacitors are stored with charge while the nonlinear resistor elements are caused to operate in accordance an input signal. The display continues to operate by virtue of the charge stored in the capacitors even after the input signal disappears, thus maintaining contrast in approximately the same level as that obtained by static driving. For this reason, the active matrix type liquid crystal display is now widely used with its increased display capacity.

The thin-film transistor (TFT) is most commonly used as the active element, although the diode and the MIM (metal-insulator-metal) element are also used.

FIG. 9 is a sectional view conceptually showing a structure of an active matrix type liquid crystal display using thin-film transistors. A thin-film transistor (TFT) portion consists of a gate electrode 12 formed on a glass substrate 11, a gate insulating film 13 formed so as to cover the gate electrode 12, a channel 14 made of amorphous silicon (a-Si) and formed over the gate electrode 12, and a source region 15 and a drain region 16 formed on the channel 14 on its both sides. An pixel electrode 19 is connected to the TFT portion, to constitute a bottom substrate A. On the other hand, a top substrate B is constituted of a glass substrate 20 and a scanning electrode 21 made of a transparent metal and formed on the glass substrate 20. A liquid crystal C is interposed between the bottom substrate A and the top substrate B, to constitute a liquid crystal element. A plurality of liquid crystal elements each having the above structure are arranged in a matrix form, to constitute an active matrix type liquid crystal display.

In this active matrix type liquid crystal display using thin-film transistors, image information (an input signal) applied to the source electrode 17 is transmitted to the liquid crystal C (interposed between the pixel electrode 19 and the scanning electrode 21) via the channel 14 that is on/off-controlled by a voltage applied to the gate electrode 12, and stored as charge by a capacitance of the liquid crystal C. However, the charge held by the liquid crystal C decreases with time because of leakage in each liquid crystal C itself, a leak current in the thin-film transistor, and other factors. Therefore; the contrast of a displayed image likely lowers with time.

The above type of liquid crystal display also has a problem that due to a complex process of forming the thin-film transistors the yield tends to be low in producing a large-size liquid crystal display.

To solve the above problems, it has been proposed that a ferroelectric material be used as the active elements instead of thin-transistors, to realize liquid crystal displays capable of producing high-quality images with a simple structure and a reduced number of production steps (for instance, Japanese Unexamined Patent Publication No. Sho. 64-4721).

FIG. 1 shows a sectional view of a one-pixel portion of an active matrix type liquid crystal display using, as drive elements, active elements made of a ferroelectric material. FIG. 2 is a top view of a bottom substrate A.

The bottom substrate A is constituted as follows. A image electrode 2, which receives image information, is formed on a glass substrate 1. A ferroelectric material layer 3 is formed over the entire pixels. Further, a pixel electrode 4 is formed on the image electrode 2 and the ferroelectric material layer 3. The ferroelectric material layer 3 may be made of a ferroelectric material selected from perovskite materials such as $TiBaO_3$, PhTi and $WO_2$, Rochelle salt, tartrates, phosphates, arsenates, alkali metal dihydrogen phosphates such as KDP, guanidine type materials such as GASH and TGS, amorphous materials of $LiNbO_3$, $LiTaO_3$, $PbTiO_3$, etc., polymers such as $PVF_2$, TrFE and a copolymer thereof, and single crystals and polycrystals of $B_{14}Ti_3O_{12}$. A top substrate B is constituted of a glass substrate 5 and a scanning electrode 6 made of a transparent metal and formed on the glass substrate 5. A liquid crystal C is interposed between the bottom substrate A and the top substrate B, to constitute a single pixel portion of the liquid crystal display.

The above active element, which serves as a drive element of the active matrix type liquid crystal display, utilizes the residual polarization phenomenon in which even after application of an electric field to a ferroelectric material is finished, an electric field caused by residual polarization remains therein and the residual polarization is erased by applying a counter electric field of opposite polarity.

Referring to FIG. 6, the electric field vs. charge density characteristic of a ferroelectric material will be described. In FIG. 6, the horizontal axis and the vertical axis represent an electric field strength E applied to a ferroelectric material and a charge density P stored in the ferroelectric material, respectively.

The charge density P increases as the electric field E is Increased. Even after application of an electric field (Eo) to the ferroelectrlc material is finished, charge called residual polarization Pr remains therein, to cause an internal electric field Ec in accordance with the density and polarization of the residual charge. If a counter electric field –Ec opposite in polarity to the residual polarization and having a magnitude for neutralizing it is applied externally, the residual polarization disappears. If an electric field opposite in polarity to and larger than the residual polarization is applied externally, charge that is opposite in polarity to the previously created charge is generated and residual polarization –Pr remains after application of the electric field –Eo is finished. As a result, an internal electric field opposite in polarity to the previous one occurs in accordance with the density of the residual charge thus generated.

The electric field that develops in accordance with the residual polarization Pr or –Pr can be applied to the liquid crystal that is connected in series to the ferroelectric material.

FIG. 3 shows an equivalent circuit of the above liquid Crystal display. In FIG. 3, symbol $P_{mn}$ represents an element (pixel) that in a series connection of a capacitance component $C_{LC}$ Of a liquid crystal portion 30 adjacent to both of the pixel electrode 4 and the scanning electrode 6 (portion of $j \times k$ in FIG. 2) and a capacitance component $C_{FE}$ of a ferroelectric material portion 40 adjacent to both of the image electrode 2 and the pixel electrode 4. Scanning electrodes of the respective sets of pixels $P_{11}$–$P_{in}$, $P_{21}$–$P_{2n}$ and $P_{ml}$–$P_{mn}$ are indicated as scanning lines $a_1$–$a_m$, and image electrodes of respective sets of pixels $P_{11}$–$P_{ml}$, $P_{12}$–$P_{m2}$ and $P_{in}$–$P_{mn}$ are indicated as image signal lines $b_1$–$b_n$. The scanning lines $a_1$l–$a_m$ and the image signal lines $b_1$–$b_n$ constitute a matrix.

FIG. 4 shows a driving method proposed for the active matrix type liquid crystal display using ferroelectric material active elements. In FIG. 4, symbols $a_1$–$a_m$ represent scanning signals to be applied to the respective scanning lines given the same symbols in FIG. 3, and symbols $b_1$–$b_n$ represent image signals to be applied to the respective image signal lines given the same symbols in FIG. 3.

Pixel rows to which image information is to be written are selected by sequentially applying scanning signals having a scanning voltage +Vs or −Vs to the scanning lines $a_1$–$a_m$. Image signal data are supplied to respective pixels connected to the scanning line to which a scanning signal is being applied by applying image signals having an image voltage +Vd or −Vd to the image signal lines $b_1$–$b_n$.

When the scanning line $a_1$is selected in a period $T_1$ of the first field by application of a voltage +Vs, a voltage −Vd is applied to the image signal line $b_2$ for the pixel $P_{12}$ which should be ON among the pixels connected to the scanning line $a_1$ and a voltage +vd is applied to the image signal lines $b_1$ and $b_n$ for the pixels $P_{11}$ and $P_{in}$ which should be OFF. Signal processing of the first field continues while the other scanning lines $a_2$–$a_m$ are sequentially selected in the similar manner. Subsequently, the second field scanning is performed.

In the second field, voltages −Vs are sequentially supplied to the scanning lines $a_1$–$a_m$ to be selected, and a voltage +Vd is applied to image signal lines for pixels which should be ON and a voltage −Vd is applied to those for pixels which should be OFF.

In the period $T_1$ shown in FIG. 4, among the pixels $P_{11}$–$P_{in}$ that are connected to the scanning line $a_1$ to which a scanning voltage +Vs is applied, the display pixel $P_{12}$ (associated liquid crystal element should be made ON) that is connected to the image signal line $b_2$ to which an image voltage −Vd is applied receives, in effect, a selection voltage V(selection) that is a sum of the scanning voltage Vs and the image voltage Vd. On the other hand, the non-display pixels $P_{11}$ and $P_{in}$ (associated liquid crystal elements should be made OFF) that are respectively connected to the image signal lines $b_1$ and $b_n$ to which an image voltage +Vd is applied receive, in effect, a non-selection voltage V(non-selection) that is a difference between the scanning voltage Vs and the image voltage Yd.

The pixels $P_{21}$, $P_{22}$, . . . , $P_{mn}$ connected to the scanning lines $a_2$–$a_n$ which is not supplied with a scanning voltage Vs and is therefore at the 0 level receive, in effect, a scanning line non-selection signal V(non-selected line) that is equal to the image voltage +Vd or −Vd.

The ferroelectric material portion 40 of each pixel is supplied with a voltage that is proportional to a ratio of the capacitance $C_{LC}$ of the liquid crystal portion 30 to the capacitance $C_{FE}$ of the ferroelectric material portion 40.

Therefore, the voltage $V_{FE}$ across the ferroelectric material portion 40 of the display pixel $P_{12}$ which receives the selection voltage V(selection) is given by $$\begin{aligned} V_{FE} &= V(\text{selection}) \times C_{LC}/(C_{LC}+C_{FE}) \\ &= (Vs+Vd) \times C_{LC}/(C_{LC}+C_{FE}). \end{aligned}$$

The voltage $V_{FE}$ across the ferroelectric material portion 40 of the non-display pixel $P_{12}$ or $P_{in}$ which receives the non-selection voltage V(non-selection) is given by $$\begin{aligned} V_{FE} &= V(\text{non-selection}) \times C_{LC}/(C_{LC}+C_{FE}) \\ &= (Vs-Vd) \times C_{LC}/(C_{LC}+C_{FE}). \end{aligned}$$

Further, the voltage $V_{FE}$ across the ferroelectric material portion 40 of each of the pixels $P_{21}$, $P_{22}$, . . . , $P_{mn}$ which receives the scanning line non-selection voltage V(non-selected line) is given by $$\begin{aligned} V_{FE} &= V(\text{non-selected line}) \times C_{LC}/(C_{LC}+C_{FE}) \\ &= \pm Vd \times C_{LC}/(C_{LC}+C_{FE}). \end{aligned}$$

As already described above, FIG. 6 shows the electric field vs. charge density characteristic of a ferroelectrlc material used in the above active matrix type liquid crystal display.

With the progress of the sequential scanning operation, when the application of the voltage $V_{FE}$ to the ferroelectric material portion 40 of each respective pixel is finished, an internal electric field remains in the ferroelectric material portion 40 due to residual polarization Pr that is proportional to the applied voltage $V_{FE}$. The internal electric field causes a voltage $V_{REM}$, which is proportional to the voltage $V_{FE}$, to be applied to the liquid crystal portion 30.

Referring to FIG. 5, a description will now be made of an electro-optical characteristic, i.e., a relationship between a voltage applied to a liquid crystal element and a light transmittance thereof. More specifically, a characteristic curve of FIG. 5 shows a relationship between an effective voltage V applied between the pixel electrode and the scanning electrode of a liquid crystal element and a light transmittance of the liquid crystal element. An effective voltage at which the liquid crystal element exhibits a transmittance of 50% is defined as an operation threshold voltage Vth. Around the threshold voltage Vth, the transmittance varies relatively steeply with the voltage applied to the liquid crystal element. That is, the transmittance varies with the voltage applied to the liquid crystal element. Therefore, in driving pixels that are arranged in a matrix form, in which case divided voltages are applied to pixels other than display pixels, crosstalks may occur to lower the contrast.

Referring to FIG. 4, when the voltage $V_s$ applied to the scanning line $a_1$ disappears after the period $T_1$, the residual polarization Pr generated by the divided voltage $V_{FE}$ remains in the ferroelectric material portion 40, and the residual polarization Pr causes the residual voltage $V_{REM}$ to develop across the ferroelectric material portion 40.

The voltage $V_{REM}$ is applied to the liquid crystal portion 30. A pixel that was given the selection voltage V(selection) which makes the voltage $V_{REM}$ exceed the operation threshold voltage Vth is made ON. On the other hand, in a pixel that was given the non-selection voltage V(non-selection) which makes the voltage $V_{REM}$ smaller than the threshold voltage Vth, the liquid crystal element is rendered, in effect, in a non-operating state (OFF), because its transmittance is smaller than 50%. Similarly, in a pixel that was given the scanning line non-selection voltage v(non-selected line) which makes the voltage $V_{REM}$ much smaller than the threshold voltage Vth, the liquid crystal element is also made OFF.

Then, in the period $T_2$, a scanning voltage Vs is applied to the scanning line $a_2$, and an image voltage +Vd or −Vd is applied to the image signal lines $b_1$–$b_n$ (see FIG. 4). As a result, the pixel $P_{2n}$ receives the selection voltage V(selection) and the pixels $P_{21}$ and $P_{22}$ receive the non-selection voltage V(non-selection). The selected pixel $P_{2n}$ is rendered in an operating state by the residual voltage $V_{REM}$ developing in the ferroelectric material portion 40.

Subsequently, the remaining scanning lines are sequentially scanned to form a one-field image.

In the next one field, the scanning signal and the image signal have voltages that are opposite in polarity to those in the first field, and the respective pixels operate in the same manner as in the first field while receiving voltages of opposite polarity.

Subsequently, the polarities of the respective voltages are reversed every field.

However, even with the above setting of the voltages, since the transmittance of the liquid crystal element varies relatively steeply with the voltage applied thereto around its electro-optical threshold voltage, crosstalks may occur. Further, if voltages that are applied to liquid crystal portions when the selection voltage V(selection) is applied to pixels are much higher than the threshold voltage Vth, a flicker likely occurs.

SUMMARY OF THE INVENTION

An object of the present invention is to provide a liquid crystal display capable of displaying clear, high-contrast images.

To attain the above object, according to the invention, capacitances of a liquid crystal portion and a ferroelectric material portion are so set that when an input signal is written to respective pixels, a liquid crystal portion of each of pixels selected for display is supplied with an effective voltage that makes the transmittance of the liquid crystal portion smaller than 50%.

A selection voltage V(selection) to be applied to a pixel to be displayed is a scanning voltage Vs plus an image voltage Vd. The capacitance ratio ($C_{CL}/C_{FE}$) between the liquid crystal portion and the ferroelectric material portion is so Set that the effective voltage applied to the liquid crystal portion of the selected pixel becomes smaller than a threshold voltage Vth that makes the transmittance of the liquid crystal portion smaller than 50%. Further, setting is so made that after the selection voltage v(selection) is removed, a residual voltage $V_{REM}$ across the liquid crystal portion becomes large enough to provide a transmittance of larger than 90%. As a result, it becomes possible to provide a liquid crystal display capable of producing clear, high-contrast images that are free of crosstalks.

DESCRIPTION OF THE PREFERRED EMBODIMENTS

An embodiment of the present invention will be hereinafter described with reference to the accompanying drawings.

Figure 1:
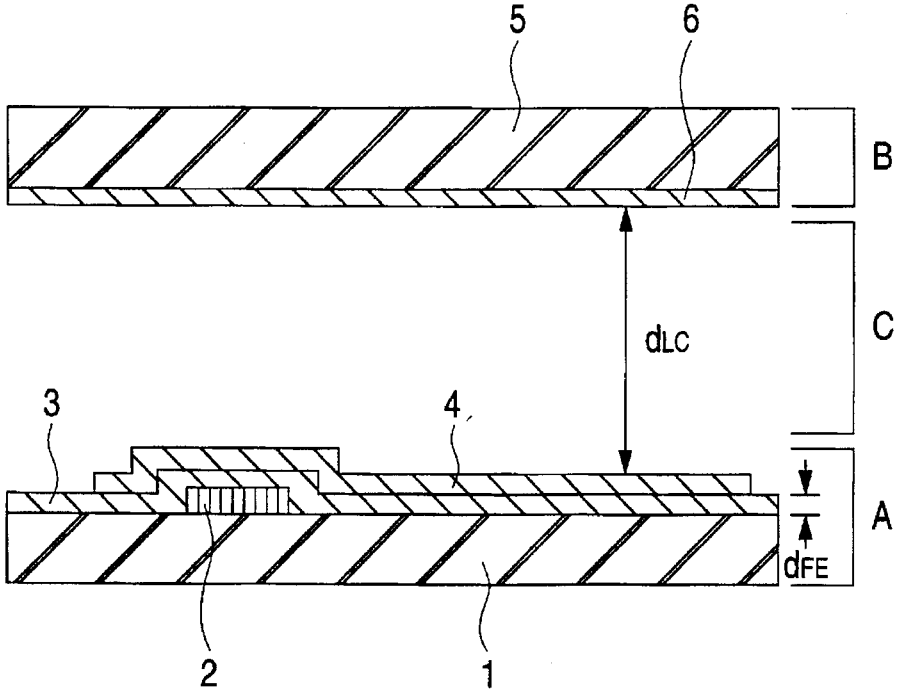
FIG. 1 is a sectional view showing a structure of a liquid crystal display using a ferroelectric material.
Figure 2:
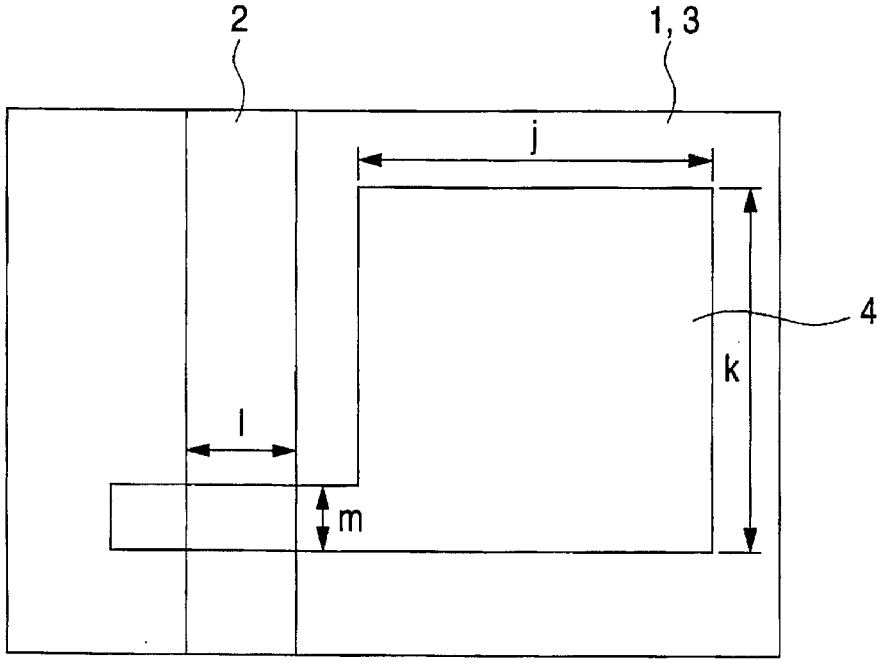
FIG. 2 is a top view showing a structure of a bottom substrate of the liquid crystal display of FIG. 1.
Figure 3:
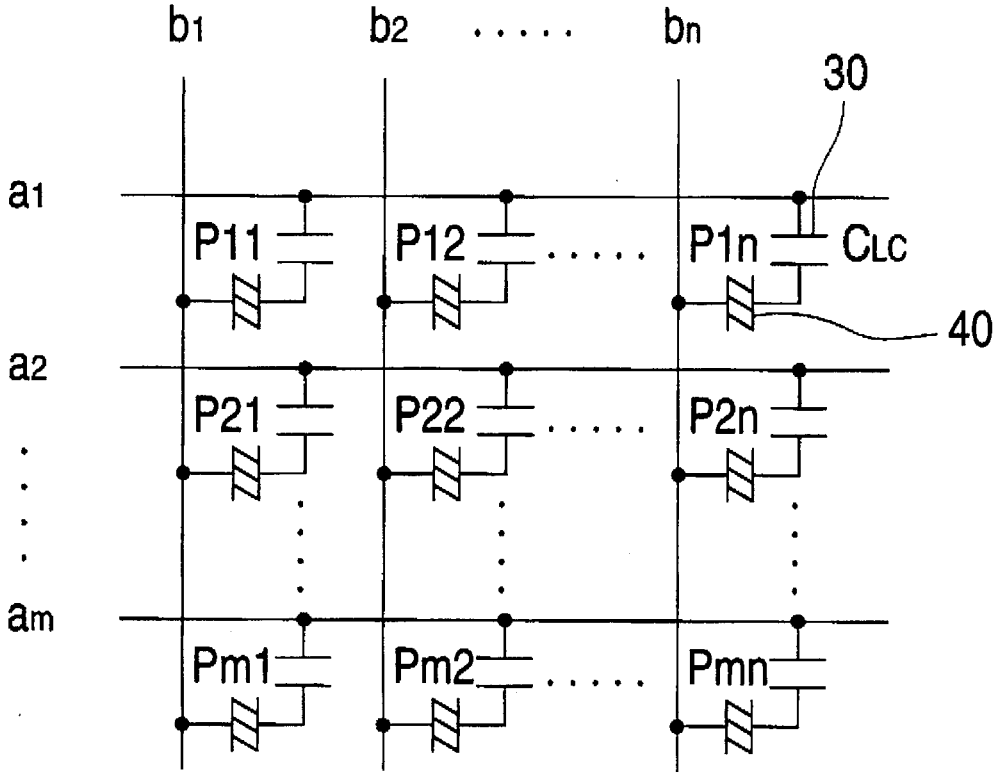
FIG. 3 shows an equivalent circuit of the liquid crystal display of FIG. 1.
Figure 4:
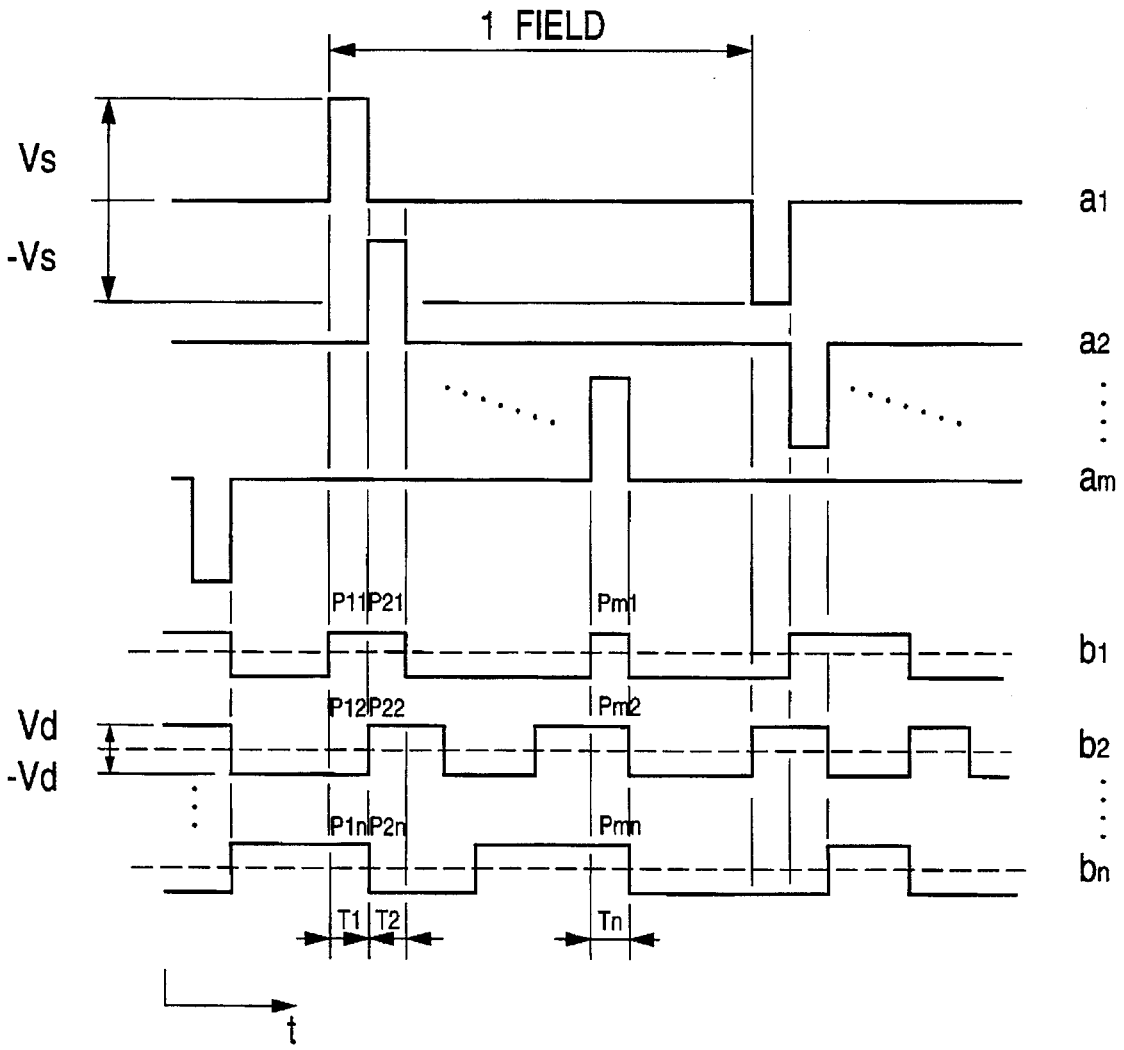
FIG. 4 is a driving time chart for the liquid crystal display of FIG. 1.
Figure 5:
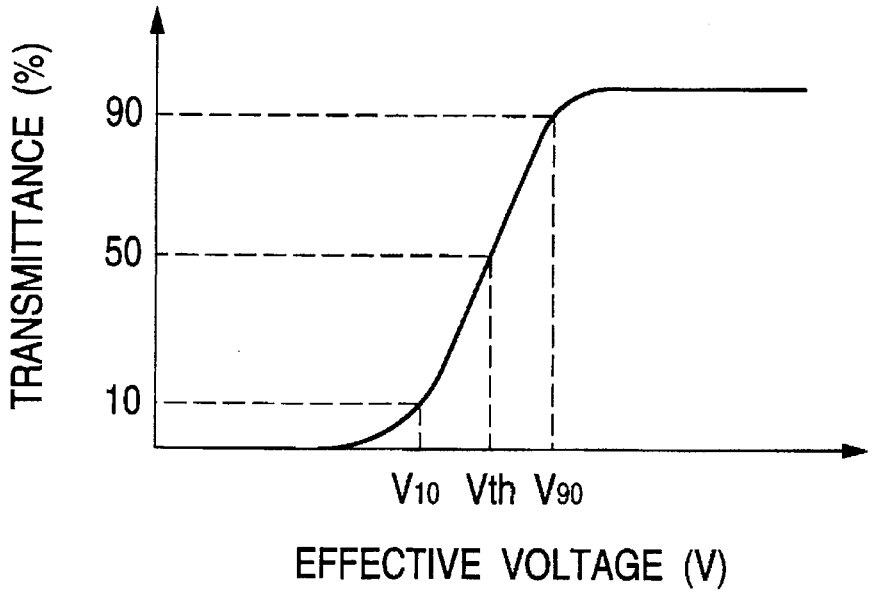
FIG. 5 shows an electro-optical characteristic, i.e., a relationship between an effective voltage applied to a liquid crystal element and a transmittance thereof.
Figure 6:
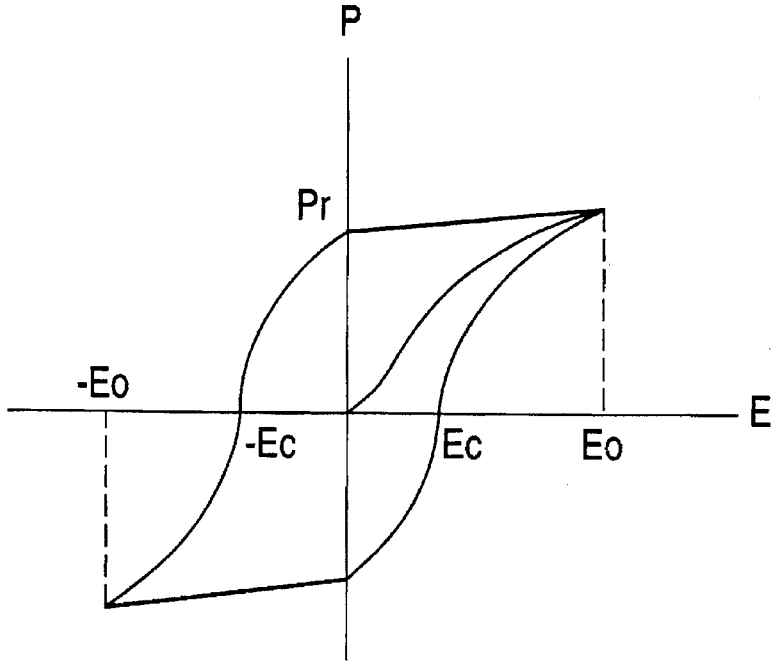
FIG. 6 shows a P-E hysteresis characteristic of a ferroelectric material.

The active matrix type liquid crystal display using active elements made of a ferroelectric material that is shown in FIGS. 1 and 2 is produced in the following manner.

First, after a chromium film is formed on a glass substrate 1 of a bottom substrate A, an image electrode 2 of 17 μm in width (1) is formed by a usual photolitho-etching technique. A ferroelectric material layer 3 of lead zirconate titanate (PZT) whose relative dielectric constant is 50 is formed at a thickness of 0.4 μm over the entire surface of the glass substrate 1 and the image electrode 2. Then, after a transparent metal layer made of, for instance, ITO is formed on the ferroelectric material layer 3, an pixel electrode 4 of 300 μm ×300 μm (j × k) and a 17-μm-wide (m) ferroelectric material top electrode extending from the pixel electrode 4 past the image electrode 2 are formed by a usual photolitho-etching technique. An ITO electrode 6 is formed on a glass substrate 5 of a top substrate B. Finally, a liquid crystal C having a relative dielectric constant $\epsilon_{LC}$ of 10 is injected into a gap between the bottom substrate A and the top substrate B, to complete a liquid crystal display.

in each pixel of the liquid crystal display thus formed, a capacitor that is constituted of the image electrode 2, the ferroelectric material top electrode, and the ferroelectric material between those electrodes has an electrode interval, i.e., a ferroelectric material thickness $d_{FE}$ of 0.4 μm, a ferroelectric material relative dielectric constant $\epsilon_{FE}$ of 50, and an electrode area (1× m) of 17 μm ×17 μm. When a voltage $V_{FE}$ of 10 V (electric field strength Eo=2.5×$10^7$ v/m) is applied between the electrodes, a residual polarization Pr is 3×$10^{-2}$ C/$m^2$ and a counter electric field Ec is 1.0×$10^7$ v/m.

On the other hand, since the relative dielectric constant $\epsilon_{LC}$ of the liquid crystal is 10, a pixel area $S_{LC}$ (j ×k) is 300 μm ×300 μm, the cell gap is 5 μm, and the vacuum dielectric constant $\epsilon_o$ is 8,854×$10^{-12}$ (F/m), the capacitance $C_{LC}$ of the liquid crystal portion having the above structure is calculated as $$\begin{aligned} C_{LC} &= \epsilon_0 \epsilon_{LC} S_{LC} / d_{LC} \\ &= [8.854 \times 10^{-12} \times 10 \times \{300 \times 10^{-6}\}^2] / 5 \times 10^{-6} \\ &= 1.59 \times 10^{-12}\ (F) \end{aligned}$$

The liquid crystal material employed above showed the following electro-optical characteristics:

Operating threshold voltage Vth: 2.5 V

Effective voltage for a transmittance of 10%: 2.0 V

Effective voltage for a transmittance of 90%: 3.0 V

If the maxims voltage applied to the liquid crystal display is set at 12 V, the selection voltage V(selection), which is applied to input an image signal to a selected pixel, is 12 V that is a sum of the scanning voltage Vs and the image voltage Vd. The maximum voltage is applied to the liquid crystal under this condition.

In this case, since the voltage $V_{LO}$ applied to a liquid crystal portion is $$V_{LC} = V(\text{selection}) \times C_{FE}/(C_{LC}+C_{FE}),$$

the capacitance $C_{FE}$ of the ferroelectric material portion should satisfy $$C_{FE} \leqq 4.18 \times 10^{-13} (F)$$

to make the voltage $V_{LC}$ lower than the operation threshold voltage Vth (=2.5 v) even when the maximum voltage 12 V is applied.

To make the voltage $V_{LC}$ at 2 V when the selection voltage V(selection) is 12 V, the capacitance $C_{FE}$ should satisfy $$C_{FE} = 3.18 \times 10^{-13} (F).$$

To obtain this specific capacitance value, since the capacitance $C_{FE}$ of the ferroelectric material portion is expressed as $$C_{FE} = \epsilon_o \epsilon_{FE} S_{FE}/d_{FE},$$

the area $S_{FE}$ of the ferroelectric material portion (1× m) is calculated as $$\begin{aligned} S_{FE} &= C_{FE} d_{FE}/\epsilon_0 \epsilon_{FE} \\ &= 2.87 \times 10^{-10} \ (\text{m}^2). \end{aligned}$$

This means a square area of 17 μm ×17 μm (1× m).

Thus, with the selection voltage V(selection) of 12 V, the voltage $V_{LC}$ of 2 V is applied to the liquid crystal portion and the voltage $V_{FE}$ of 10 V is applied to the ferroelectric material portion.

The residual voltage $V_{REM}$ that develops across the liquid crystal portion after the application of the selection voltage V(selection) is finished is calculated as $$\begin{aligned} V_{REM} &= S_{FE} Pr/(C_{LC} + C_{FE}) \\ &= 4.5 \text{ V} \end{aligned}$$

where Pr $-3 \times 10^{-2}$ (C/m$^2$) with 10 V applied across the ferroelectrlc material portion.

This value of the residual voltage $V_{REM}$ sufficiently larger than the effective voltage 3.0 V to produce the transmittance of 90% of the liquid crystal portion.

Similarly, the residual voltage $V_{REM}$ can be made smaller than 2.0 V by setting the voltage $V_{FE}$ at 5 V. To this end, the non-selection voltage V(non-selection), i.e., Vs – Vd, should be smaller than 6 V. Thus, the transmittance can be made smaller than 10%.

In view of the above, each of the scanning voltage Vs and the image voltage Vd may be set at 6 V, so that the transmittance of liquid crystal elements of selected pixels can be made larger than 90% and that of liquid crystal elements of non-selected pixels can be made smaller than 10%. Thus, it is possible to prevent crosstalks.

The above embodiment is summarized as follows. The liquid crystal display comprises a first electrode, a first capacitor portion including a ferroelectric material and connected to the first electrode, a second capacitor portion including a liquid crystal material and connected in series to the first capacitor portion, a second electrode connected to the second capacitor portion, and voltage applying means for applying one of at least two voltages between the first and second electrodes, wherein the at least two voltages and/or capacitances of the first and second capacitor portions are controlled so that the liquid crystal material is rendered non-transparent while each of the at least two voltages is applied, and is rendered transparent or non-transparent depending on an applied voltage after removal of the applied voltage.

Figure 7:
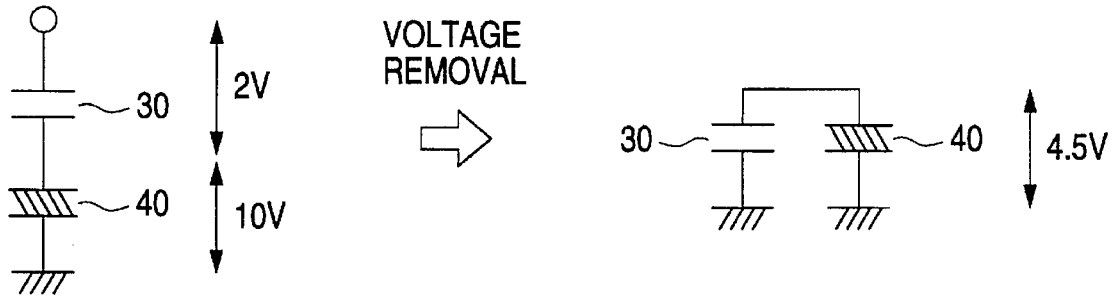
FIGS. 7 and 8 shows a simplified model of the liquid crystal display of FIG. 1.
Figure 8:
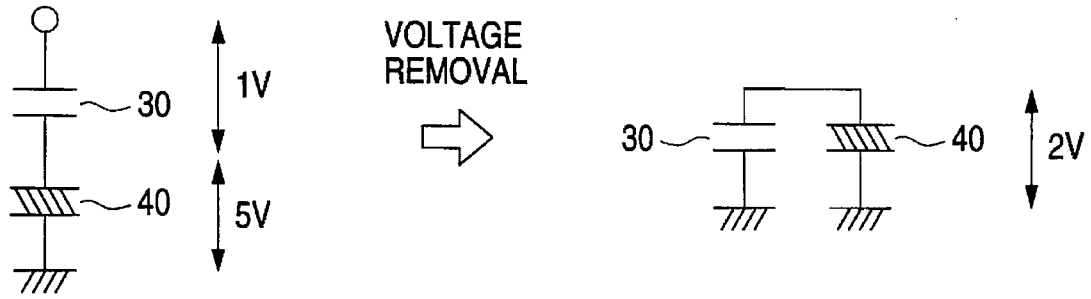
Figure 9:
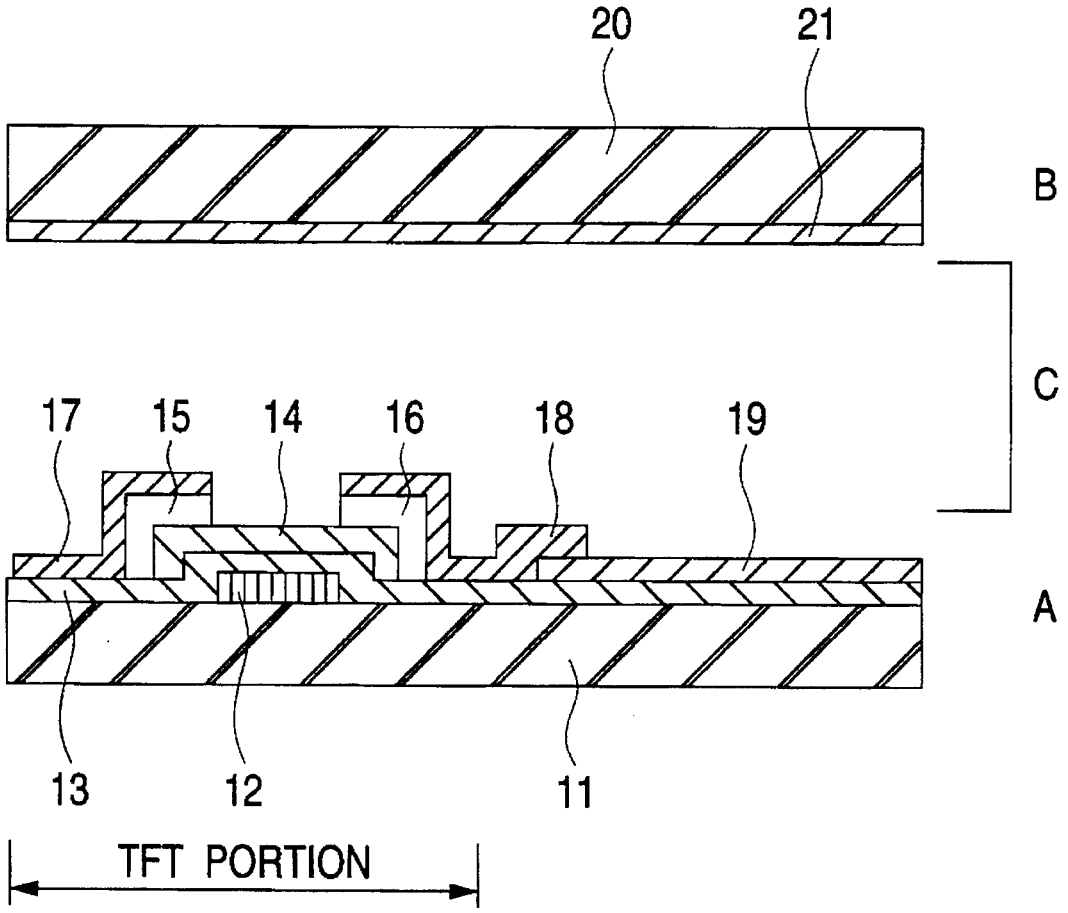
FIG. 9 PRIOR ART
FIG. 9 is a sectional view showing a structure of a liquid crystal display using thin-film transistors.

The operation will be described below using a simplified model shown in FIGS. 7 and 8. FIG. 7 shows a state in which a selection voltage of 12 V is applied between the image electrode 2 and the scanning electrode 6. The capacitances of the liquid crystal portion 30 and the ferroelectric material portion 40 are so set that, in spite of the application of the selection voltage, an effective voltage applied to the liquid crystal portion 30 becomes smaller than the threshold voltage Vth for the transmittance of the liquid crystal. Further, the capacitances of the liquid crystal portion 30 and the ferroelectric material portion 40 are so set that after the selection voltage is removed, a voltage resulting from only the internal residual charge in the ferroelectric material portion 40 causes a voltage higher than the threshold voltage to develop across the liquid crystal portion 30. In this case, the liquid crystal portion 30 is rendered transparent. On the other hand, FIG. 8 shows a case in which a non-selection voltage is applied between the image electrode 2 and the scanning electrode 6. The non-selection voltage and the above capacitance ratio are so set that the liquid crystal portion 30 is rendered non-transparent both during and after the application of the non-selection voltage.

More specifically, referring to FIG. 7, the capacitance ratio between the liquid crystal portion 30 and the ferroelectric material portion 40 is so determined that even when a selection voltage of 12 V is applied, only 2 V (smaller than Vth) is applied to the liquid crystal portion 30. When the selection voltage is removed and then the grounding is effected, an effective voltage of 4.5 V (larger than Vth) develops across the liquid crystal portion 30 due to the internal polarization of the ferroelectric material layer 40. On the other hand, referring to FIG. 8, the capacitance ratio is so determined that both when a non-selection voltage of 6 V is applied and when it is removed, effective voltages of 1 V and 2 V (both smaller than Vth) develop across the liquid crystal portion 30, respectively.

As described above, according to the invention, the maximum voltage applied to the liquid crystal is so set as to be smaller than the threshold voltage Vth in the electro-optical characteristics of the liquid crystal material even while a pixel is selected. As a result, it becomes possible to provide a liquid crystal display capable of producing clear, high-contrast images that are free of crosstalks. Apparently, there occurs no problem while a pixel is not selected, because in this case the voltage applied to the pixel is lower than the selection voltage.

What is claimed is:

1. A method of driving an active matrix liquid crystal display having pixels, each pixel comprising an image electrode formed on a first insulating substrate, a ferroelectric material portion formed on the image electrode, a pixel electrode formed on the ferroelectric material portion, a scanning electrode formed on a second insulating substrate, and a liquid crystal portion disposed between the pixel electrode and the scanning electrode, said method comprising the steps of:

applying first selection signals across the image and scanning electrodes of the pixels selected for display to develop first voltages across the liquid crystal portions that render light transmittance of the liquid crystal portions less than 50% and to develop second voltages across the ferroelectric material portions; and removing the first selection signals from the pixels selected for display, leaving first residual voltages of the ferroelectric material portions of magnitudes effective to render the light transmittance of the liquid crystal portions greater than 90%.

2. A liquid crystal display device including a plurality of pixels, each pixel comprising:

a first electrode;

a first capacitor portion including a ferroelectric material and connected to the first electrode;

a second capacitor portion including a liquid crystal material and connected in series to the first capacitor portion;

a second electrode connected to the second capacitor portion;

voltage applying means for applying one of at least first and second voltages across the first and second electrodes;

wherein the liquid crystal material is rendered non-transparent in response to the application of either of the at least first and second voltages across the first and second electrodes, and wherein the liquid crystal material is rendered transparent in response to the removal of the first voltage and rendered non-transparent in response to the removal of the second voltage.

3. The method according to claim 1, further comprising the steps of:

applying second selection signals across the image and scanning electrodes of the pixels selected for display to develop third voltages across the liquid crystal portions that render the light transmittance of the liquid crystal portions less than 50% and to develop fourth voltages across the ferroelectric material portions;

removing the second selection signals from the pixels selected for display leaving second residual voltages of the ferroelectric material portion of magnitudes that maintain the light transmittance of the liquid crystal portions at less than 50%.

4. The method according to claim 3, wherein the first selection signals are of a greater voltage than the second selection signals.

5. The method according to claim 1, wherein the second and fourth voltages developed across the ferroelectric material portions are respectively greater than the first and third voltages developed across the liquid crystal portions.

6. The method according to claim 3, wherein the second and fourth voltages developed across the ferroelectric material portions are respectively greater than the first and third voltages developed across the liquid crystal portions.

7. The liquid crystal display device of claim 2, wherein the first voltage is greater than the second voltage.

8. The liquid crystal display device of claim 2, wherein capacitances of the ferroelectric and liquid crystal materials are such that the application of either the first or second voltages develops a greater voltage across the ferroelectric material than across the liquid crystal material.

9. The liquid crystal display device of claim 8, wherein a residual voltage of the ferroelectric material renders the liquid crystal material transparent in response to the removal of the first voltage and renders the liquid crystal material non-transparent in response to the removal of the second voltage.

10. The liquid crystal display device of claim 9, wherein the first voltage is greater than the second voltage.

* * * * *